United States Patent [19]

Staggs et al.

[11] Patent Number: 4,971,389

[45] Date of Patent: Nov. 20, 1990

[54] HIGH CHAIR ATTACHMENT FOR CHAIRS

[76] Inventors: Raymond H. Staggs, 221 SE. 2nd; Tony A. Clapp, 112½ SE. 1st, both of Moore, Okla. 73160

[21] Appl. No.: 495,680

[22] Filed: Mar. 19, 1990

Related U.S. Application Data

[63] Continuation-in-part of Ser. No. 383,471, Jul. 24, 1989, abandoned.

[51] Int. Cl.[5] ..... A47B 39/00

[52] U.S. Cl. ..... 297/174; 297/153

[58] Field of Search ..... 297/174, 134, 135, 464, 297/250, 254, 251, 153, 154

[56] References Cited

U.S. PATENT DOCUMENTS

| | | | |
|---|---|---|---|
| 1,043,927 | 11/1912 | Harris | 297/153 |
| 2,553,122 | 5/1951 | Weatherson | 297/134 |
| 2,658,554 | 11/1953 | Specter et al. | 297/134 |
| 2,919,748 | 1/1960 | Alden, Sr. | 297/174 X |
| 3,369,039 | 2/1968 | Telarico | 297/154 X |
| 3,383,134 | 5/1968 | Webb et al. | 297/153 |
| 3,516,709 | 6/1970 | Nader | 297/153 |

FOREIGN PATENT DOCUMENTS

| | | | |
|---|---|---|---|
| 1054573 | 2/1954 | France | 297/134 |

*Primary Examiner*—Jose V. Chen

*Attorney, Agent, or Firm*—Robert K. Rhea

[57] ABSTRACT

A temporary high chair conversion for an adult chair includes a child's eating tray horizontally disposed above an adult chair seat by a pair of U-shaped frame members removably supporting the tray and overlying the chair seat.

The rearward end portions of the U-shaped frame members are connected with a pair of opposed chair back supporting standards by a telescoping tube and spring arrangement urging the semicircular chair back standard engaging members into frictional contact with the respective chair back standard.

1 Claim, 1 Drawing Sheet

HIGH CHAIR ATTACHMENT FOR CHAIRS

CROSS REFERENCE TO RELATED APPLICATION

This application is a continuation-in-part of an application filed by us in the United States Patent and Trademark Office on July 24, 1989, under Ser. No. 07/383,471 for High Chair Attachment for Chairs, now abandoned.

BACKGROUND OF THE INVENTION

1. Field of the Invention

This invention relates to readily applicable and removable attachments which may be applied to the seat portion of an adult chair by an attaching means gripping the uprights of the chair back which temporarily converts the chair into what may be termed a high chair and feeding tray for small children.

Most eating establishments such as restaurants and cafeterias furnish high chairs for patrons who have small children. However, many homes and particularly some apartments have limited living space, particularly in the dining area or the kitchen where ample space is limited which makes it impractical to use a conventional high chair for the reason the spacing between the legs of high chairs is usually considerably greater in overall dimensions than an adult chair in order to provide non-tipping safety of the high chair by the child when standing. Furthermore, if a couple has two or more small children requiring the use of conventional high chairs then the space requirement is even more critical in the home or apartment.

This invention provides a temporary conversion of an adult chair to a high chair type feeding tray for infants which may be readily removed from the adult chair and stored in a relatively small space.

2. Description of the Prior Art

Many restaurants supply a hollow block-like plastic member having a seat contour therein for placement upon the seat of an adult chair for supporting a child who has outgrown the size of a high chair and is capable of sitting at a table, needing only what is called a "booster" for lifting the child to a comfort level for eating from an adult table. This booster type support for rather small children is not satisfactory for the reason most small children require some support to maintain them in the high chair or converted adult chair and furthermore, since they wiggle considerably they need a seat belt type restraint to remain in the chair.

The most pertinent prior patent is believed to be U.S. Pat. No. 2,919,748. This patent discloses a tubular frame defined by opposing side members U-shaped in general configuration with the bight portion of the U-shape projecting forwardly of a chair and defining a pair of horizontal upper arms supporting a child's tray transversely of a chair and a pair of lower arms resting on the seat of a chair, with the lower arms integrally connected in a U-shape projecting across the rearward portion of an adult chair seat. The device of this patent requires a harness type attachment for securing the frame to the chair.

This invention is distinctive over this patent and other similar patents by providing a pair of substantially U-shaped frames having the respective bight portion projecting forwardly with the frames positioned on opposing sides of an adult chair seat. Upper horizontal arms of each frame removably support respective end portions of a child's eating tray and lower arms of these side frames project rearwardly and are connected with the inward confronting surfaces of an adult chair back upstanding leg members projecting upwardly from the seat and defining the back rest of the adult chair. These semicircular back rest standard grips are interconnected by telescoping expansion means constantly urging the semicircular grips apart and into frictional contact with the chair back standards thus insuring that the child's tray remains in place. The lateral U-shaped side frames prevent the child from falling from the chair at either of its sides.

SUMMARY OF THE INVENTION

A generally rectangular child's tray having an upstanding perimeter rim defines a substantially U-shaped recess at least partially surrounding the torso of a child when seated on a chair with the tray in eating position in front of the child. A pair of tubular members form tray supporting frame side members and are doubled back upon themselves in vertical edgewise relation forming a U-shape with the bight portion of the U-shape projecting forwardly and terminating adjacent the forward limit of an adult chair seat.

The rearward end portions of the legs forming the U-shaped frame members are respectively connected with upper and lower end portions of a chair back grip which is semicircular in transverse section. The length of these U-shaped grips is selected in accordance with the dimensions of the chair back standards or legs to be engaged thereby for normally supporting the tray against forward, lateral or rearward movement relative to the chair seat. These U-shaped grip members are interconnected transversely of the chair by a telescoping rod and tubular member having an expansion spring interposed between the inner end of the rod and the inner end limit of the tubular member which constantly urges the semicircular grip members apart and into frictional engagement with the standards supporting a chair back.

The principal object of this invention is to provide a high chair-like conversion tray for an adult chair which may be readily connected with substantially any adult chair having a horizontal chair seat and a back rest supported by laterally disposed standards to which the device may be readily attached and removed from, is relatively inexpensive and contains few moving parts and may be easily maintained in a sanitary condition.

DESCRIPTION OF THE PREFERRED EMBODIMENTS

Figure 2:
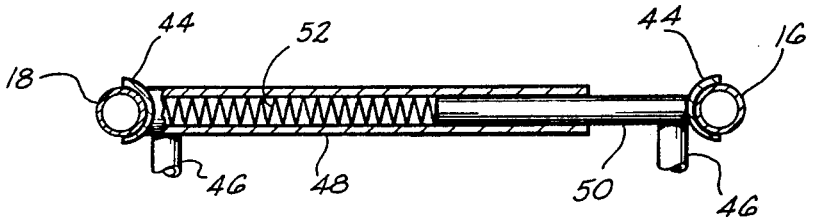

Like characters of reference designate like parts in those figures of the drawings in which they occur.

Figure 1:
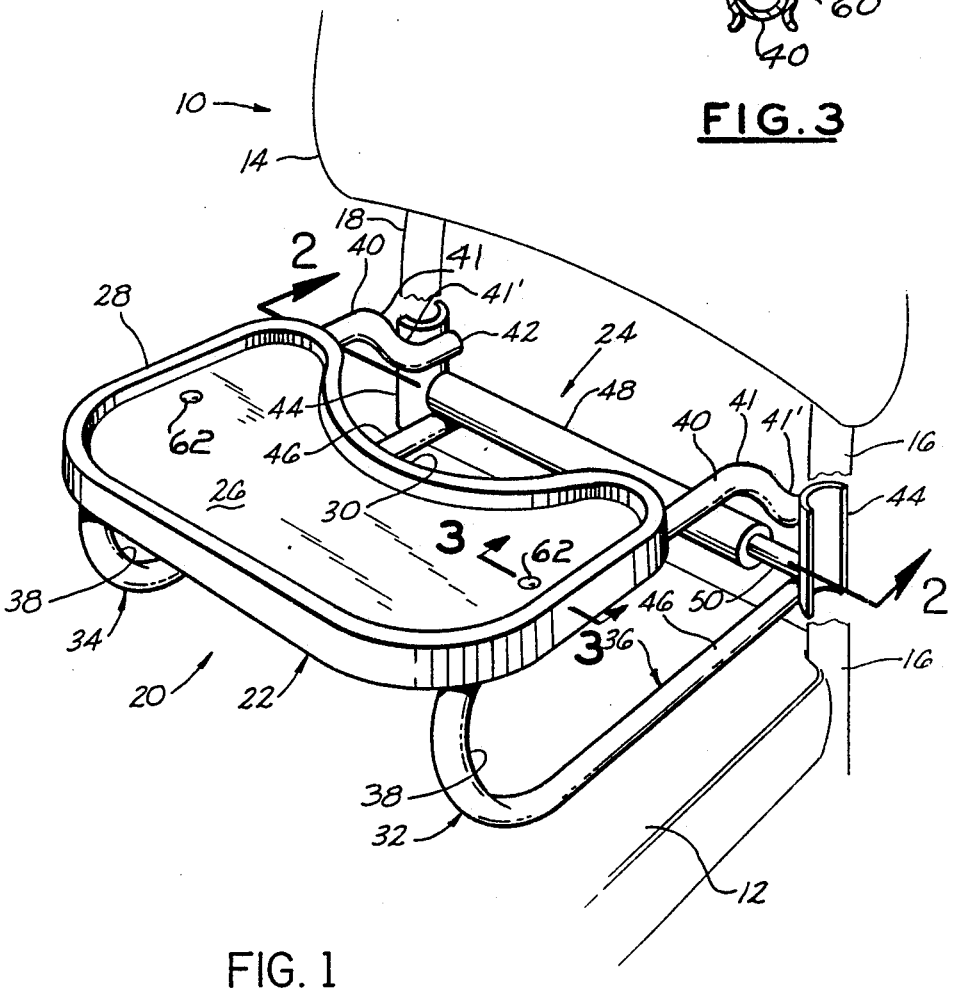
FIG. 1 is a perspective view of the device mounted on and attached to a chair fragmentarily illustrated by seat and back portions; and, FIGS. 2 and 3 are vertical cross sectional views, to a larger scale, taken substantially along the lines 2—2 and 3—3, respectively, of FIG. 1.

In the drawings:

Referring more particularly to FIGS. 1 and 2, the reference numeral 10 indicates a substantially conventional adult chair having a seat 12 and a back rest 14 supported by lateral standards 16 and 18 at the respective rearward side limits of the chair seat formed by extending the chair legs upwardly above the horizontal limit of the seat 12.

The reference numeral 20 indicates the device which comprises a child's tray 22 and a frame means 24. The tray 22 is substantially conventional being generally rectangular in overall configuration having a flat horizontally disposed bottom 26 and an upstanding wall 28 extending in endless fashion around its perimeter. The tray 22 is further characterized by a generally U-shaped recess 30 in its rearward limit which partially, at least, conforms to the torso of a child when seated on the chair seat behind the tray 22.

The frame means 24 comprises lateral frames 32 and 34. Each frame is formed from an elongated length of tubing 36 doubled back upon itself in vertically spaced relation to form a forwardly projecting bight portion 38 and define upper horizontal arms 40 extending rearwardly of the tray and turned downwardly and then rearwardly as at 41 and 41' terminating in short end portions 42. The end portions 42 are respectively rigidly connected with the upper end portion of a pair of elongated substantially semicircular, in transverse section, chair standard engaging grips or clamps 44.

The other leg 46 of the U-shaped frame similarly extends rearwardly in horizontal contact with the upper surface of the chair seat 12 and has its rearward end portion similarly rigidly connected with the depending end portion of the respective chair standard engaging grip 44. These two grips are interconnected transversely of the chair at the rearward limit of the seat by an elongated tubular member 48 connected at one end with one grip 44 and at its other end, telescopically receiving loosely, one end portion of an elongated rod 50 having its opposite end portion rigidly attached to the other of the semicircular grips 44 in horizontal aligned relation with respect to the attached end of the tube 48.

As shown in FIG. 2 an expansion spring 52 is interposed between the inward end of the rod 50 and the surface of the adjacent chair standard grip 44 opposite the rod for the purpose of constantly urging the chair standard grips 44 in opposing directions and maintaining the device 20 on the chair seat against forward, rearward or lateral movement relative to the chair seat.

Figure 3:
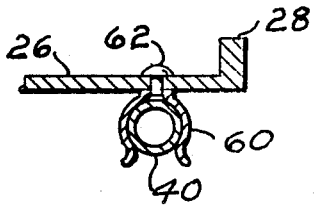

Referring also to FIG. 3, the reference numeral 60 indicates a downwardly open spring clip secured to the tray bottom 26 in selected inwardly spaced relation with respect to each tray end portion perimeter wall 28 by a rivet or pin 62 so that the spring clip may be at least partially angularly rotated horizontally about the vertical axis of the pin 62. The spring clip removably engages the respective horizontal arm 40 of each side frame 32 and 34.

OPERATION

In operation with the tray 22 removed from the side frames 32 and 34 the chair frame end portions connected with the semicircular chair back standard grips 44 are manually forced toward each other by compressing the expansion spring 52 and when placed between the standards 16 and 18 are released so that they may spring outwardly into engagement with the standards, assuming that the leg portions 46 are in contact with the chair seat 12. The tray 22 is placed on the horizontal upper arms 40 and held in place by the spring clips gripping the arms. The clips 60 permit adjustment of the tray toward or away from the chair back. The pivotal mounting of the clip 60 and looseness of the fit of the rod 50 in the tube 48 permits some angular variation of the plane of the frame side member 32 relative to the plane of the frame side member 34 to compensate for variations in spacing between chair standards 16 and 18. The child is then placed within the opening formed between the U-shape 30 of the tray and the tube 48. Obviously, the device may be provided with straps or a strap maintaining the child on the seat against sliding out from under the tray 22 or through one of the U-shaped frame members.

The device is removed from the chair after the child has been removed from the chair by first removing the tray 22 and thereafter simply manually compressing the rearward end portions of the U-shaped frames 34 toward each other and manually removing the device from the chair 10.

Obviously the invention is susceptible to changes or alterations without defeating its practicability. Therefore, we do not wish to be confined to the preferred embodiment shown in the drawings and described herein.

We claim:

1. In an adult chair having a leg supported seat defined by front, rear and opposing side portions and having a backrest supported above the horizontal plane of the seat by back leg extended standards, the improvement comprising:

a high chair feeding tray horizontally overlying the forward portion of said seat;

rearwardly projecting bracket means underlying and removably supporting opposing end portions of said tray above said seat;

said bracket means comprising an elongated tube doubled back upon itself to define a U-shape having a bight portion projecting forwardly of the chair seat and rearwardly projecting legs;

a spring clip depending from the respective end portion of said tray and releasably gripping said tray underlying bracket means;

back rest standard grip means secured to the rearward portion of said bracket means, said grip means including a pair of chair standard leg grips secured to the rearward end portion of said bracket legs, each grip of said pair of grips having a vertical recess cooperatively nesting an intermediate portion of a chair standard;

resilient means maintaining said grip means in frictional gripping contact with said back rest standards, said resilient means comprising telescoping members interposed between and connected with the respective grip of said pair of grips; and, an expansion spring normally biasing said telescoping members toward a telescopically extended position.

* * * * *